US006222796B1

(12) United States Patent
Rosen

(10) Patent No.: US 6,222,796 B1
(45) Date of Patent: Apr. 24, 2001

(54) ASTROLOGICAL WATCH

(76) Inventor: Lauren Rosen, 24270 Cloverlawn, Oak Park, MI (US) 48237

( * ) Notice: Subject to any disclaimer, the term of this patent is extended or adjusted under 35 U.S.C. 154(b) by 0 days.

(21) Appl. No.: 09/134,681

(22) Filed: Aug. 14, 1998

(51) Int. Cl.[7] ..... G04B 19/26
(52) U.S. Cl. ..... 368/15; 368/223; 368/281
(58) Field of Search ..... 368/281, 282, 368/277, 278, 69, 223, 227, 15–17

(56) References Cited

U.S. PATENT DOCUMENTS

| | | | | |
|---|---|---|---|---|
| 1,750,505 | | 3/1930 | Bulka . | |
| 4,583,864 | | 4/1986 | Graves | 368/17 |
| 4,659,231 | * | 4/1987 | Barkouki | 368/15 |
| 4,711,583 | | 12/1987 | Oechslin et al. | 368/16 |
| 4,712,923 | * | 12/1987 | Martin | 368/10 |
| 4,759,002 | | 7/1988 | Cash | 368/15 |
| 4,766,579 | | 8/1988 | Sporring | 368/190 |
| 5,023,849 | | 6/1991 | Vaucher | 368/15 |
| 5,208,790 | * | 5/1993 | Sato | 368/15 |
| 5,457,663 | * | 10/1995 | Mejaski | 368/15 |

FOREIGN PATENT DOCUMENTS

| | | | | |
|---|---|---|---|---|
| 0489652 | * | 6/1992 | (EP) | 368/5 |

* cited by examiner

*Primary Examiner*—Bernard Roskoski
(74) *Attorney, Agent, or Firm*—Joseph N. Breaux

(57) ABSTRACT

The concept of an astrological watch is that of a watch which provides a daily horoscope based on ones astrological sign. The astrological watch matches up with a birth sign. The watch contains a computer chip that provides daily horoscopes for the sign of the person, based upon their birth date and time, covering one entire year. An LCD readout allows the person to read their individual daily horoscope each day. In addition, the astrological watch provides the function of a standard electronic digital watch.

3 Claims, 2 Drawing Sheets

ASTROLOGICAL WATCH

TECHNICAL FIELD

The present invention relates to astronomic timepieces and more particularly to an astrological watch. The astrological watch comprises a liquid crystal display having an alphanumeric output wherein the watch contains information regarding one of the astrological signs for approximately a one year period. Each day the user can access a new horoscope type of prediction and read it on the alphanumeric display.

BACKGROUND ART

Numerous astronomic timepieces have been provided in prior art. For example, U.S. Pat. Nos. 1,750,505 to Bulka; 4,583,864 to Graves; 4,711,583 to Oechslin et al.; 4,759,002 to Cash; 4,766,579 to Sporring; and 5,023,849 to Vaucher all are illustrative of such prior art. While these units may be suitable for the particular purpose to which they address, they would not be as suitable for the purposes of the present invention as heretofore described.

The Bulka U.S. Pat. No. 1,750,505 discloses an astronomical clock. In an astronomical clock, a dial structure including an inner dial member having characters on the face thereof indicating the hours of the day. An outer dial member is disposed around the inner dial member and has characters thereon representing the calendar months and the days thereof. Hands are adapted for cooperation with the dial structures. Means for driving the hands includes a shaft supporting one of the hands and adapted for a revolution once in twenty-four hours. A rotatable sleeve is disposed around the shaft and adapted to carry the other of the hands. The sleeve being operatively connected to the shaft for rotation therewith in the ratio of 366 to 1. The inner dial being mounted on the sleeve for rotation therewith. The first mentioned hand cooperating the inner dial whereby to indicate the hour of the day, and the second mentioned hand cooperating with the outer dial whereby to indicate the day of the month.

The Graves U.S. Pat. No. 4,583,864 discloses a solar system clock. A novelty clock is provided wherein a spherical representation of the earth rotates about the face of the clock as would a second hand. While rotating about the face of the clock, the earth also rotates upon its own axis, thereby providing a more realistic and appealing visual effect. The special motion of the earth is achieved by a motion producing mechanism driven by the rotational force of the shaft which ordinarily drives the second hand of the clock.

The Oechslin et al. U.S. Pat. No. 4,711,583 discloses an astronomical wristwatch. A watch designed to display, by means of indicators several astronomical magnitudes. The indicators are driven by means of a planetary gear train which is rotatingly supported by means of a ball bearing within a support ring of the watch. The drive force, as well as the time reference, are provided by a work simultaneously driving the planet-wheel carrier of the planetary gear train and the gear clusters mounted thereon. Each of the clusters has a reduction ratio depending on the indicator it is intended to drive.

The Cash U.S. Pat. No. 4,759,002 discloses a clock. A clock having a housing which contains two internal discs and a motor for rotation of those discs on a shaft is disclosed. An hour disc is provided having a shaded region representing night and an unshaded region representing day. The hour disc is positioned to appear through an opening in the clock face. The face of the clock may have one or more openings to expose the minute and hour discs. One of the openings has a numerical representation of hours provided on the clock face there around. The clock is arranged so that the line separating the dark and light regions of the hour disc indicates the hour of day by pointing to a number on the face, and also graphically represents the amount of time from and to the previous and next sunrise or sunset.

The Sporring U.S. Pat. No. 4,766,579 discloses a timepiece having a control stem correcting mechanism with at least two setting positions. A basic clockwork, initially arranged in such a way as to comprise two supplementary indicators, of the date and of the days of the week, which have been removed, is provided with an additional module carrying supplementary indicators, which can number two, three or even four. These indicators being separate from the basic clockwork, their position can be chosen very freely by a constructor. In order to prevent having to provide the clockwork with one or several supplementary control members, for the correction of the indicators, a correcting mechanism of the basic clockwork, comprising a control stem operating a sliding pinion is used. A shaft of the sliding pinion has been extended up to a frame of the additional module and carries a pinion meshing, according to the sense in which the control stem is operated, either with a wheel belonging to a correcting gear train of one of the supplementary indicators, or with a pinion belonging to a correcting gear train of another supplementary indicator.

The Vaucher U.S. Pat. No. 5,023,849 discloses an astronomic timepiece and disc intended for use therein. The invention concerns an astronomic timepiece enabling a simple display of the daily value of an astronomic magnitude having an annual cycle. The timepiece comprises a month disc, at least a portion of which is visible through an opening provided in the dial. The development of the astronomic magnitude is represented in the form of a curve in a frame of reference one coordinate of which indicates the date and the other indicates a value of the astronomic magnitude.

GENERAL SUMMARY DISCUSSION OF INVENTION

The astrological watch consists of a standard type electronic wristwatch fabricated of attractive metals or possibly plastic. It will feature an LCD readout and several control buttons to activate or change the various functions. The display face has a picture or emblem representing a specific zodiac sign. In addition to the electronic digital watch circuitry, the astrological watch includes an internal computer chip which is programmed with a horoscope of the specific zodiac sign over a period of one year. The watch will be designed so that the computer chip could be easily replaced at the end of each year. The display face of the astrological watch can include a small jewel, or facsimile representing a precious stone for the zodiac month sign. This small jewel could also be part of the horoscope forecast button that is pressed to provide the daily horoscope.

A primary object of the present invention is to provide an astrological watch that will overcome the shortcomings of the prior art devices.

Another object is to provide an astrological watch that contains a computer chip, which will have the daily horoscope of a specific zodiac sign of a person, based upon the birth date and time, covering one entire year.

An additional object is to provide an astrological watch in which an LCD readout will allow the person to read their individual daily horoscope each day, while also functioning as a standard type electronic wristwatch.

A further object is to provide an astrological watch that is simple and easy to use.

A still further object is to provide an astrological watch that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
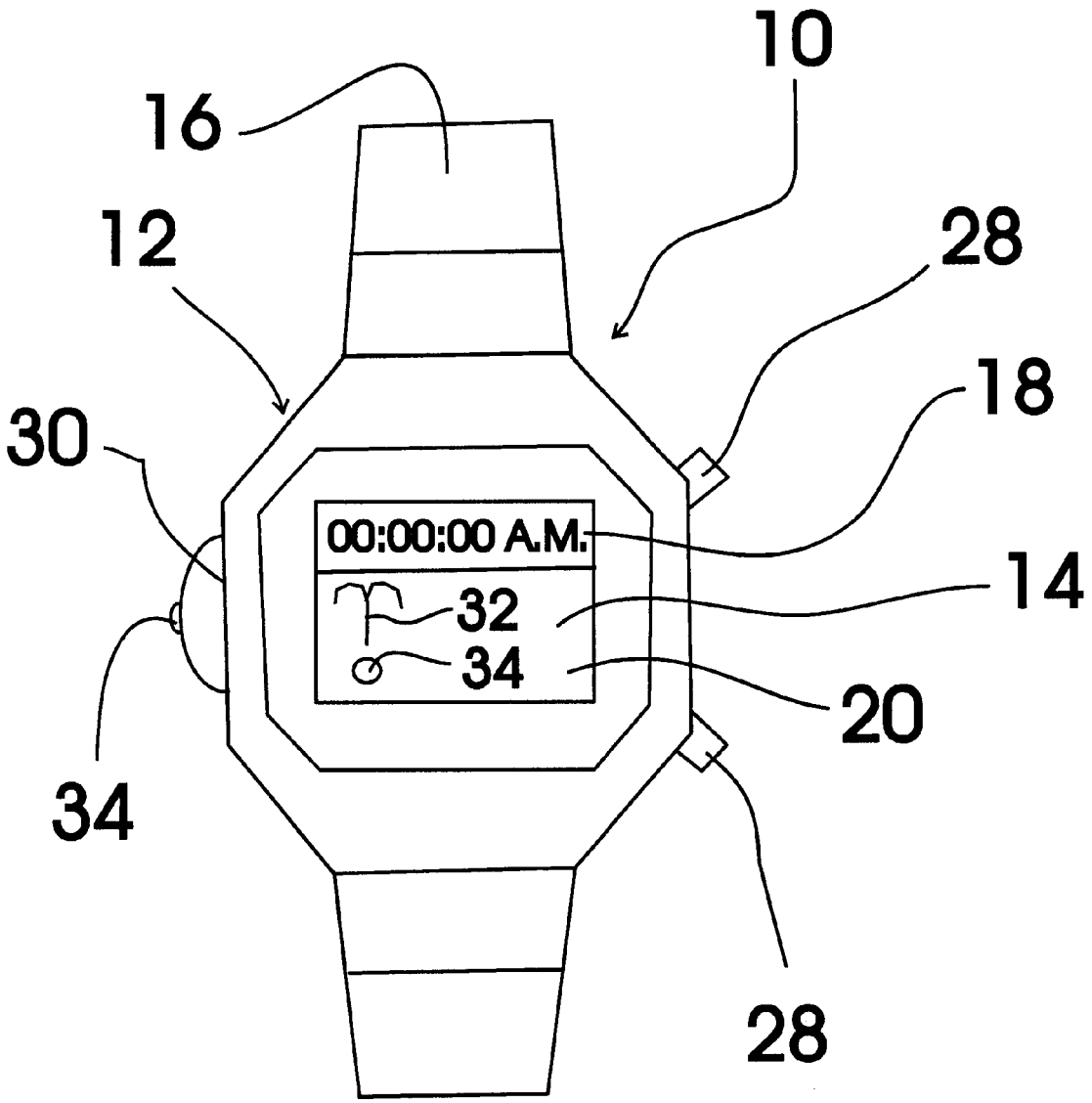
FIG. 1 is a plan view of the present invention.
Figure 2:
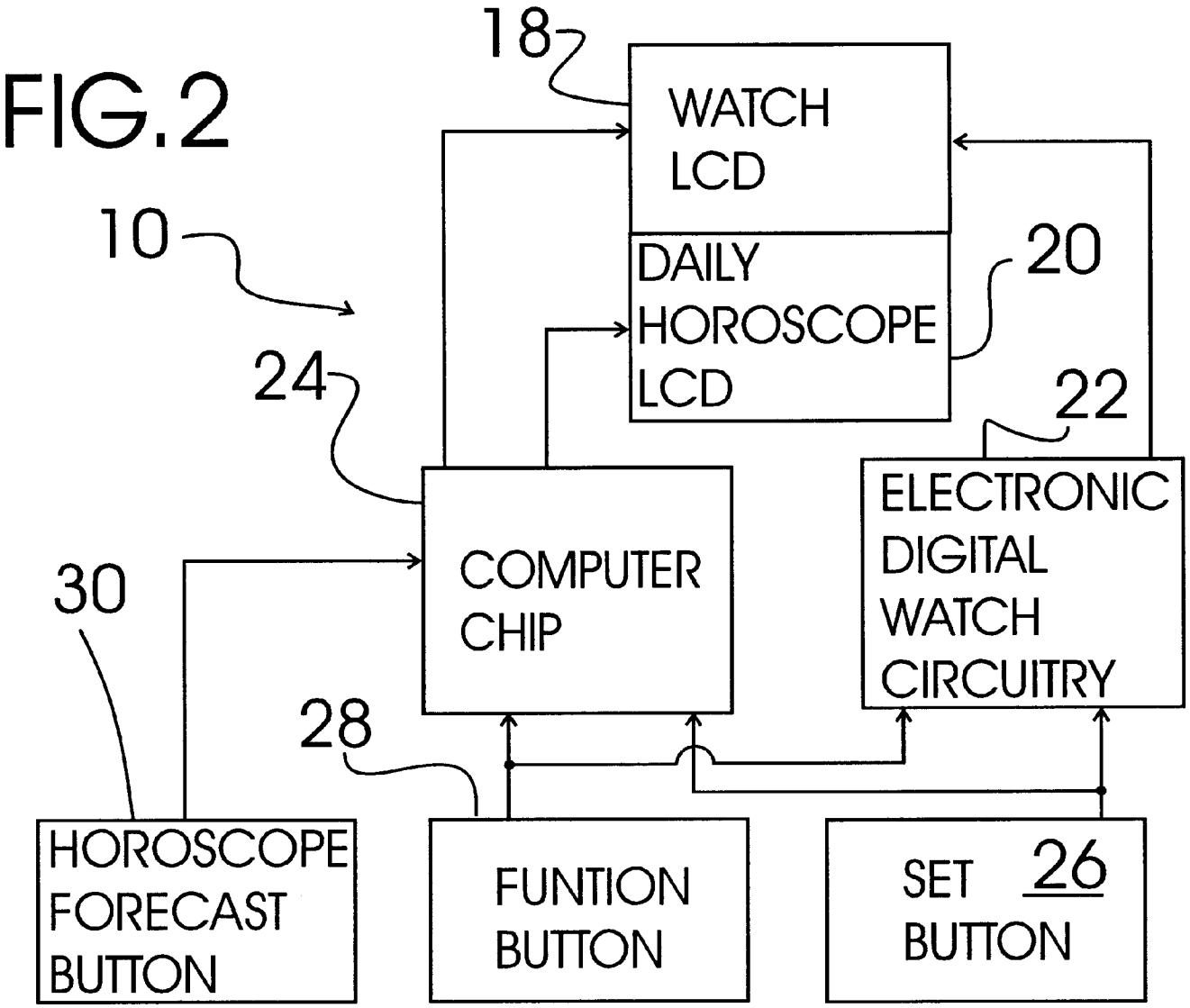
FIG. 2 is a block diagram of the various components in the present invention.

Turning now descriptively to the drawings, in which similar reference characters denote similar elements throughout the several views, FIGS. 1 and 2 illustrate the various features of the present invention being an astrological watch 10 comprising a case 12 having a display face 14. Band 16 extends from case 12 and is worn about a wrist of a person. A watch liquid crystal display 18 is under display face 14 of case 12, while daily horoscope liquid crystal display 20 is also under display face 14 of case 12. An electronic digital watch circuitry 22 carried within case 12 is electrically connected to watch liquid crystal display 18. A computer chip 24 carried within case 12 is electrically connected to watch liquid crystal display 18 and daily horoscope liquid crystal display 20. A set button 26 on the case 12 is electrically connected to electronic digital watch circuitry 22 and computer chip 24. When set button 26 is depressed in various preselected sequences it will set time, day/date, and alarm into electronic digital watch circuitry 22, and set birthday, date and time specifically for the person into the computer chip 24.

Function button 28 on case 12 is electrically connected to electronic digital watch circuitry 22 and computer chip 24. When function button 28 is depressed in various preselected sequences it will activate electronic digital watch circuitry 22 to cause watch liquid crystal display 18 to show time, day/date and alarm setting, and will activate computer chip 24 to cause watch liquid crystal display 18 to show birthday, date and time specifically for the person. A horoscope forecast button 30 on case 12 is electrically connected to computer chip 24. When horoscope forecast button 30 is depressed it will activate computer chip 24 to cause daily horoscope liquid crystal display 20 to show a daily astrological forecast specifically for the person.

Computer chip 24 is programmed with a horoscope of a specific zodiac sign for a period of one year. Computer chip 24 is removable from case 12, so that computer chip 24 can be replaced at the end of each year with a new one.

Display face 14 of case 12 includes a zodiac month sign 32 thereon specifically for the person. Display face 14 of case 12 can contain a small jewel 34, or facsimile representing a precious stone for a zodiac month sign specifically for the person. Horoscope forecast button 30 can also contain the small jewel 34, or representing the precious stone for the zodiac month sign specifically for the person.

The astrological watch 10 is designed with a dual function. This highly unique watch would give the person the regular time. However, they would also be able to see their own individualized daily forecast of their horoscope. The computer chip 24 would be programmed according to each person's exact time of birth, date and year they were born. A program via computer will calculate the forecasts and daily horoscope which would then be fed into the computer chip 24 in the individual's watch.

For example, if the person is a Gemini, born Jun. 19, 1959 at 7:05 p.m., and was to get a normal chart done for a year, it would be prepared by an astrologer on paper. The person could also look up their horoscope in the newspaper, radio, magazines, etc. The present invention introduces a brand new look in the design of the watch. This provides a fun, informative, novel, trendy, innovative way of personalizing a message to the individual.

A person will be able to have a daily unique personalized horoscope at the push of a button on a watch that represents their zodiac sign. The watch would be a conversation piece, very novel, commemorates with the coming millennium, space, etc.

It can be seen from the preceding description that in use, the person or manufacturer will simply program the date and time of the person's birth into the astrological watch 10 with the set button 26. The person would then enjoy the benefit of being able to read their personalized horoscope on each day of the year by merely depressing the horoscope forecast button 30 and watch the daily horoscope on the LCD screen 20. At the end of the year, the person can replace the computer chip 24 with a new one, programmed with their horoscope for the new year. Use of the astrological watch 10 will provide a very unique and convenient method of allowing anyone to be able to have access to their daily horoscope based upon the time and date of birth, in addition to having the use of a standard wristwatch.

It is noted that the embodiment of the astrological watch described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An astrological watch comprising:

a case having a display face;

a band extending from said case to be worn about a wrist of a person;

a watch liquid crystal display under said display face of said case;

a daily horoscope liquid crystal display under said display face of said case;

a digital electronic watch circuitry carried with said case and electrically connected to said watch liquid crystal display;

a computer chip carried within said case and electrically connected to said watch liquid crystal display and said daily horoscope liquid crystal display;

a set button on said case electrically connected to said electronic digital watch circuitry and said computer chip, so that when said set button is depressed in various preselected sequences it will set time, day/date, and alarm into said electronic digital watch circuitry, and set birthday, date and time specifically for the person into said computer chip;

a function button on said case electrically connected to said electronic digital watch circuitry and said computer chip, so that when said function button is depressed in various preselected sequences it will activate said electronic digital watch circuitry to cause said watch liquid crystal display to show time, day/date and alarm setting and will activate said computer chip to cause said watch liquid crystal display to show birthday, date and time specifically for the person; and a horoscope forecast button on said case electrically connected to said computer chip, so that when said horoscope forecast button is depressed it will activate said computer chip to cause said daily horoscope liquid crystal display to show a daily astrological forecast specifically for the person;

said computer chip is programmed with a horoscope of a specific zodiac sign for a period of one year, whereby said computer chip is removable from said case, so that said computer chip can be replaced at the end of each year with a new one said horoscope forecast button includes a small jewel or facsimile representing a precious stone for a zodiac month sign specifically for the person.

2. The astrological watch as recited in claim 1, wherein:

said display face of said case includes a zodiac month sign thereon specifically for the person.

3. The astrological watch as recited in claim 1 wherein:

said display face of said case includes a small jewel, or facsimile representing a precious stone for a zodiac month sign specifically for the person.

* * * * *